United States Patent [19]

Karal et al.

[11] Patent Number: 4,753,552

[45] Date of Patent: Jun. 28, 1988

[54] DRY AND/OR WET ONE-ATMOSPHERE UNDERWATER SYSTEM

[75] Inventors: Eva R. Karal, Oslo; Rolf Kvamsdal, Trondheim, both of Norway

[73] Assignee: Kvarner Subsea Contracting A/S, Lysaker, Norway

[21] Appl. No.: 867,818

[22] Filed: May 27, 1986

[30] Foreign Application Priority Data

Jun. 6, 1985 [NO] Norway ..... 852290

[51] Int. Cl.[4] ..... B63G 8/00

[52] U.S. Cl. ..... 405/189; 405/185; 405/188; 114/314; 114/322; 114/335

[58] Field of Search ..... 405/185, 188, 190, 191, 405/204, 170, 189; 166/338; 114/323, 333, 325, 313, 314, 335, 322; 244/159, 161

[56] References Cited

U.S. PATENT DOCUMENTS

| | | | |
|---|---|---|---|
| 1,210,840 | 1/1917 | Reeves | 114/323 |
| 1,777,693 | 10/1930 | Gordon | 114/323 |
| 1,814,689 | 7/1931 | Grieshaber | 114/325 |
| 2,116,200 | 5/1938 | Hermanson | 114/323 |
| 3,034,471 | 5/1962 | Aschinger | 405/188 |
| 3,268,091 | 8/1966 | Melton | 244/161 X |
| 3,353,364 | 11/1967 | Blanding et al. | 114/314 X |
| 3,495,562 | 2/1970 | Fahlman et al. | 114/314 |
| 3,625,171 | 12/1971 | Bailey | 114/314 |
| 3,702,597 | 11/1972 | Odum et al. | 405/188 |
| 4,010,619 | 3/1977 | Hightower et al. | 405/191 |
| 4,117,688 | 10/1978 | Ball | 405/188 |
| 4,153,001 | 5/1979 | Krasberg | 405/185 |
| 4,192,384 | 3/1980 | Croy | 405/188 |
| 4,253,779 | 5/1981 | Grognu | 405/170 |
| 4,398,846 | 8/1983 | Agdern | 405/185 X |
| 4,426,173 | 1/1984 | Richart et al. | 166/338 |
| 4,427,385 | 1/1984 | Galerne | 405/185 X |

FOREIGN PATENT DOCUMENTS

| | | | |
|---|---|---|---|
| 2748875 | 5/1979 | Fed. Rep. of Germany | 114/322 |

*Primary Examiner*—Randolph A. Reese
*Assistant Examiner*—Anthony Knight
*Attorney, Agent, or Firm*—Merchant, Gould, Smith, Edell, Welter & Schmidt

[57] ABSTRACT

A one-atmosphere underwater modular system is provided. The modular system comprises components which can be manipulated and attached to one another through use of a submarine or the like. A variety of components are provided including: a maneuvarable submarine component; a bottom frame; a two-connection module; a one-connection module; and christmas tree modules. A variety of means and methods for connection in various orientations is disclosed. The system is specifically adapted for use in the recovery of natural resources, such as for oil and gas recovery.

9 Claims, 10 Drawing Sheets

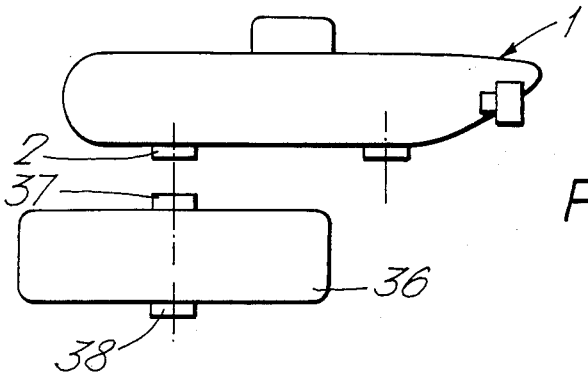
Fig. 13.
Fig. 14.
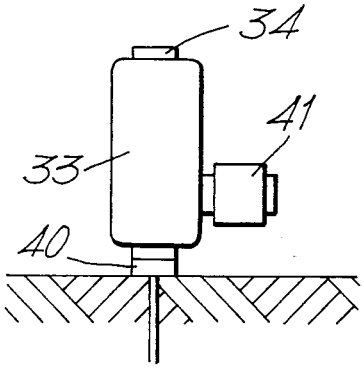
Fig. 15.
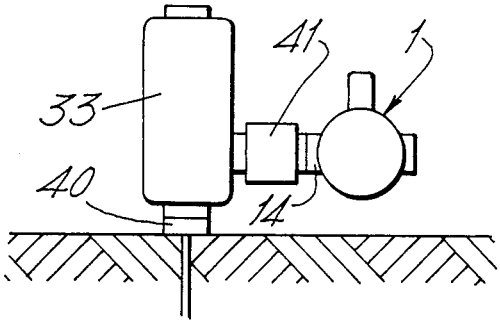
Fig. 16.
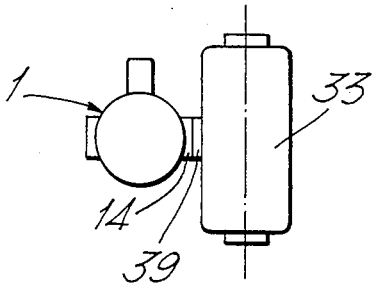
Fig. 17.
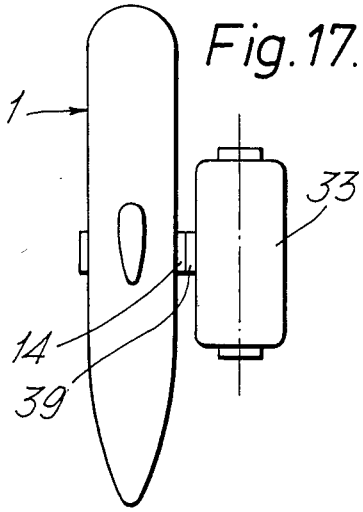

DRY AND/OR WET ONE-ATMOSPHERE UNDERWATER SYSTEM

This invention relates to a dry and/or wet one-atmosphere underwater system for the recovery of natural resources, comprising pressure-resistant units containing the necessary/desired production equipment, including also control/habitat facilities, i.e. auxiliary facilities, and connection (access) means between the pressure-resistant units.

The underwater system has been developed specially for oil and gas production offshore. Diverless underwater production systems for the recovery of oil and gas are being developed, based on a real need to be able to produce deposits discovered in deep water. By "diverless" is here meant that hyperbaric divers are not used. Such underwater production svstems are in particular characterized by the method or methods used to install and maintain the different components and subsystems. Traditionally, surface vessels have generally been used as the starting point for installation, while various robot techniques are employed particularly for routine maintenance. To avoid a dependency on weather, it has been proposed that one uses autonomous, freight-carrying submarines operating from bases on land.

If one always can operate in a submerged state, the influence of weather will be eliminated. One has further realized that considerably safer and more accessible systems can be constructed when people can be brought down to the ocean floor to perform necessary operations as much as possible directly at the site. As a result of this realization, various dry systems have been proposed where the components are placed in pressure-resistant chambers, filled with air or nitrogen at the pressure of one atmosphere, so that personnel can work there, with or without fresh air masks and without having to go through time-consuming and biologically undesirable phases of compression and decompression. It is also possible to fill such chambers with water and then later to empty them by intervention, planned or incidental, because such operations are not expected to be of particularly high frequency.

Wet systems, that is, systems where the components are installed and maintained in a "wet" environment, also have supporters and are constantly being further developed. When hyperbaric diving is impossible or undesirable, all work on such systems must be accomplished by means of manipulators. These can be remotely controlled and monitored via TV systems.

In connection with a recognition of the importance of bringing people as close as possible to the very site of operation, proposals have been advanced with the object of mounting manipulators on submarines or on diving bells. Even if the manipulators then can be operated with direct eye contact with the work area, such equipment has a very limited operating capacity and requires components adapted in every detail to the manipulators and to the tools these can employ.

So far, dry one-atmosphere underwater systems for oil/gas production, comprising components in the form of pressure-resistant cylinders containing the necessary/desired equipment (such as manifolds, separating equipment, equipment for gas compression and for water injection and control/habitat facilities), have not been considered economically competitive because diving technique has managed to develop in step with the increase in depths to be exploited. However, a growing interest by offshore operators in recovering resources at greater depths has led to a renewed interest in underwater systems where for example Christmas trees, manifolds and other equipment are encapsulated in pressure chambers on the ocean floor and thus can be serviced directly by personnel working under normal atmospheric conditions.

Consequently, there is a clear need for new development within this field. As a result of the varied nature of the offshore fields, new solutions must have the greatest possible flexibility in use. A demand naturally made on such an underwater system is that it can demonstrate procedures of installation and maintenance (including replacement) which involve easy access and great flexibility. Moreover, the underwater system should preferably be completely independent of the weather. It should also possess a substantially greater work capacity than that achieved by systems based on manipulators.

According to the invention, there is proposed a dry/wet one-atmosphere underwater system for the recovery of natural resources, comprising pressure-resistant units which contain the necessary/desired production equipment, including also control/habitat facilities and connection (access) means between the pressure-resistant units, and the characteristics of the novel underwater system are that its units and connection means are components fitting into a module (building block) system with fastening (coupling) and access devices having measurements and distance standardized according to the system, and that it further comprises an autonomous submarine provided with corresponding fastening and access devices having measurements and distance standardized according to the system.

The system is first intended to be used for the installation, maintenance, inspection, repair, replacement and total, final removal of: wellheads, including Christmas trees with a protective structure, manifolds, production equipment on the ocean floor and flowlines and control cables.

Later, the system can be further developed for well maintenance and drilling. The invention is not limited to the recovery of oil/gas, but can also conceivably be used for the recovery of other natural resources in the ocean, on the ocean floor or below it.

According to the invention, the novel underwater system is constructed around one or more autonomous submarines having the range and capacity to operate from bases on land and preferably/if desired in a submerged state at all times.

One has, according to the invention, recognized that it is of the greatest importance to use, as much as possible, a "pure" submarine, that is, a submarine which has been built and equipped primarily as a submarine, with no additions except the desired coupling and access devices, because one thus can make optimal use of the submarine. Coupling and access devices can with advantage be incorporated into the streamlined shape of the submarine (its outer hull) or be given a suitable hydrodynamic design.

It is in this connection also of importance to keep the submarine's deplacement (size) down—both on account of building costs, operating costs and maneuverability.

It is planned to use personnel for all operations, primarily in direct contact, but also with tools, manipulators, etc., possibly provided with fresh air masks for work in an inert atmosphere or with frogman suits for work in a wet environment.

The pressure in the components is maintained around 1 bar at all times. It is considered important to have a comfortable environment and that all transfer of personnel can occur as comfortably as possible under atmospheric conditions. This has significant implications with regard to safety, of a positive character.

On the submarine there may also be mounted modules which supplement its own functions, such as surveying the bottom, inspection (with automatic documentation), provision of additional habitat and energy capacity, etc.

In principle, all production systems and all equipment will be mounted in wet or dry pressure chambers. These chambers can be used as buoyant bodies for transport, either from a base on land, a surface craft or a helicopter, in that they can be fastened to (integrated with) the submarine via preferably combined fastening and access devices having standard measurements and distance.

The installations are constructed from one or more units, usually called modules. If there are two or more such units these can be connected by connection means where there is space for pipes, cables and possibly also passage of personnel.

The work of coupling together the unit and the connection means can take place in a dry atmosphere after the parts are locked together. This will be of great importance for quality compared with corresponding operations in a wet environment. The mutual danger of contamination for the environment and the system is eliminated. The invention makes possible the use of tools directly without employing manipulators or the like. Thus, many more work operations can be performed per time unit than is the case when manipulators are used.

The invention shall be further described with reference to the drawings, first in connection with an envisioned installation of an underwater system, which for example can be an underwater production plant.

Figure 5:
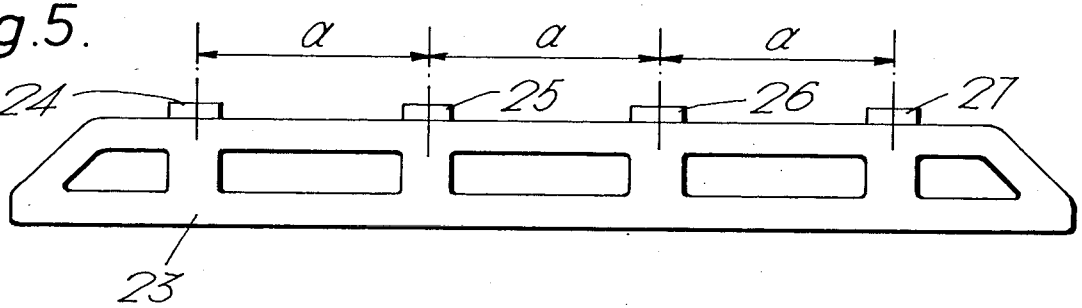
Figure 6:
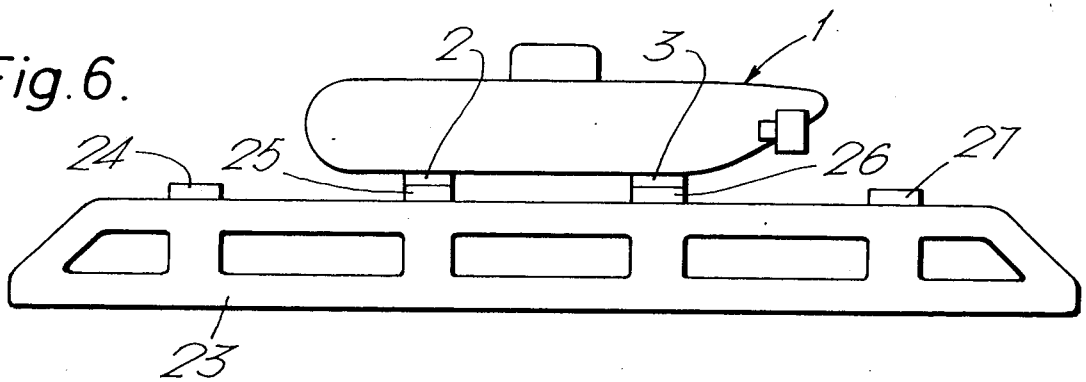
Figure 7:
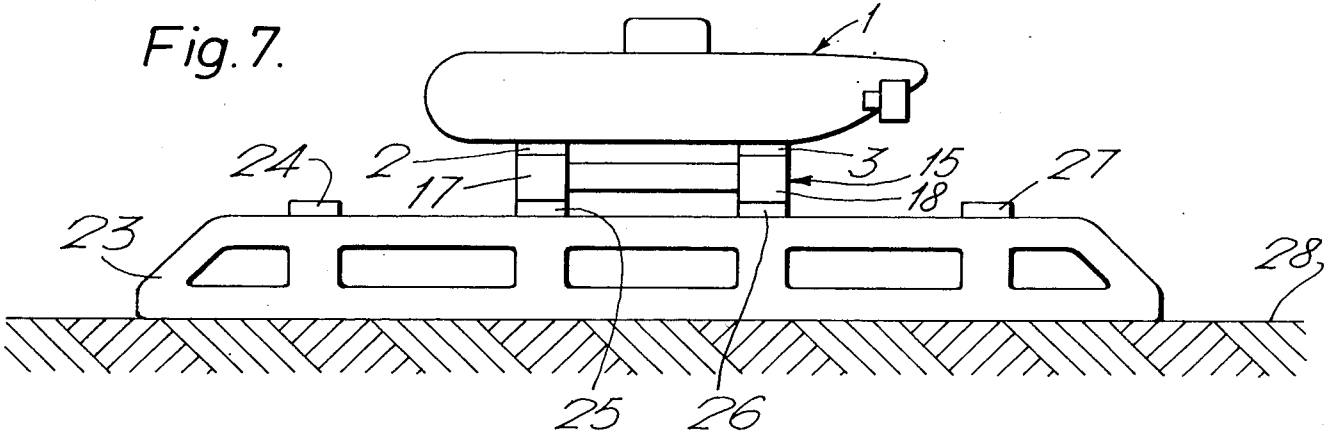
Figure 8:
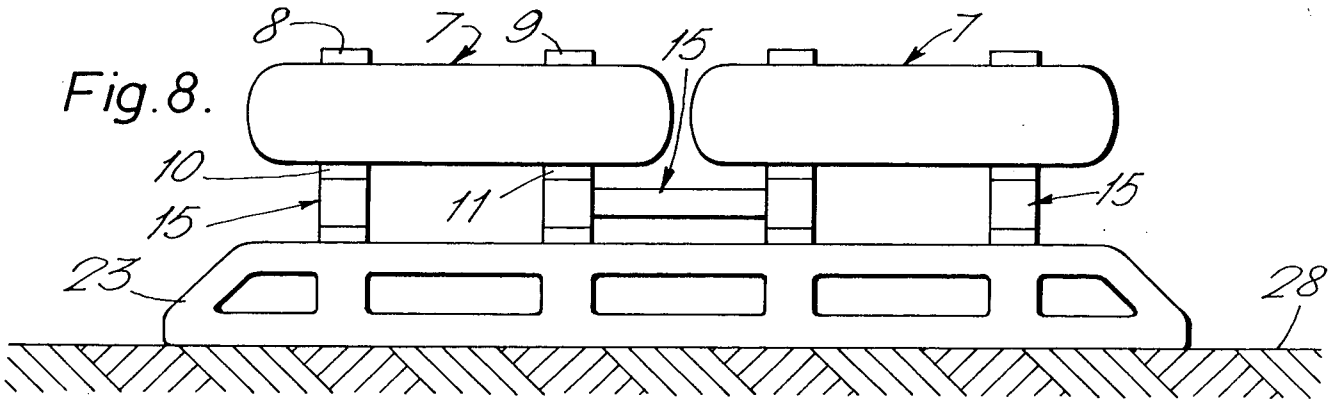
Figure 9:
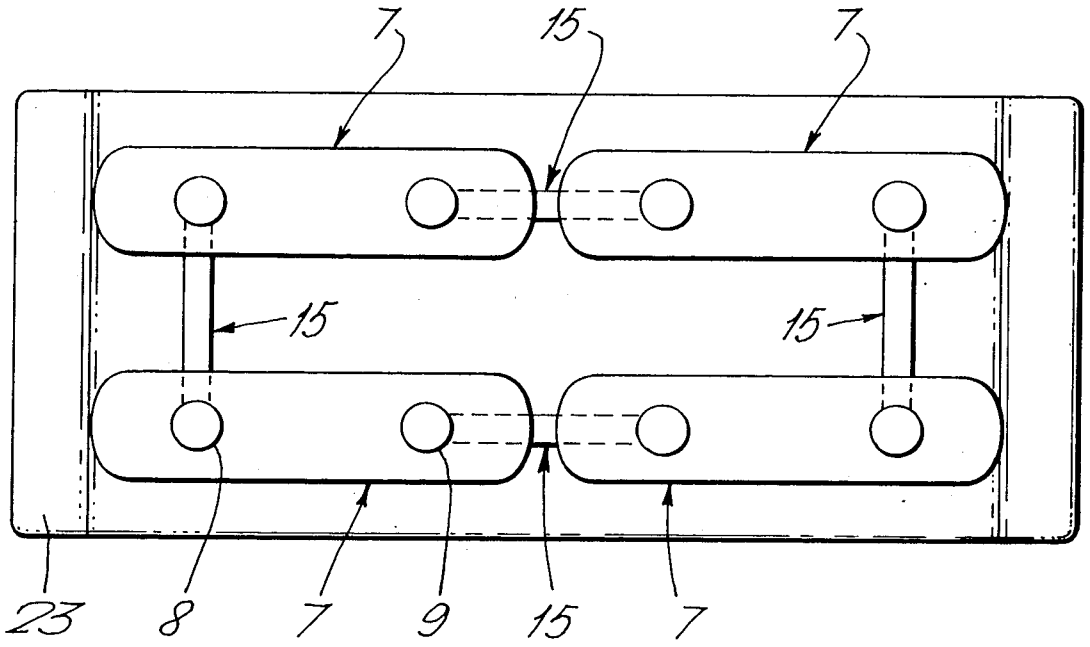
Figure 10:
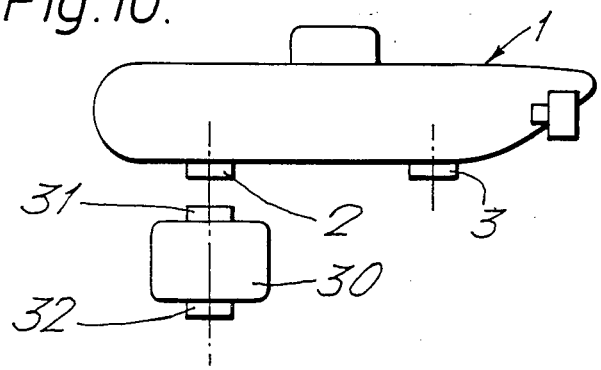
Figure 11:
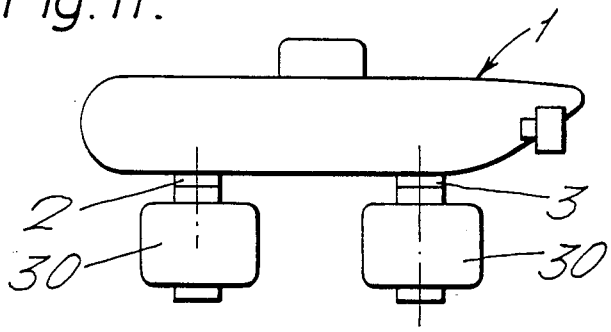
Figure 12:
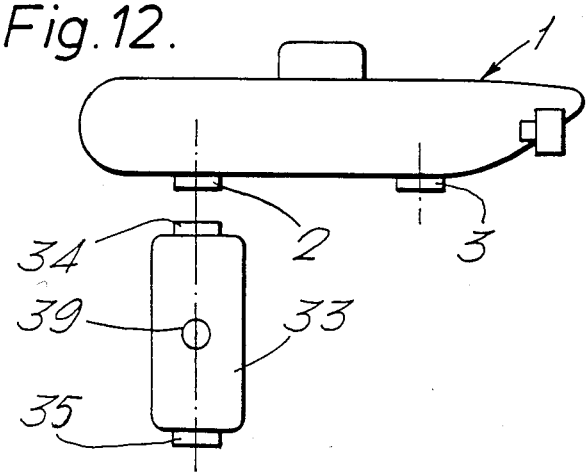
Figure 18:
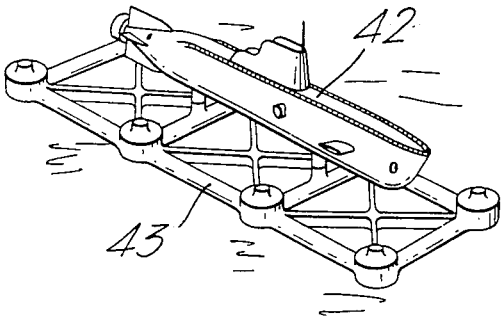
Figure 19:
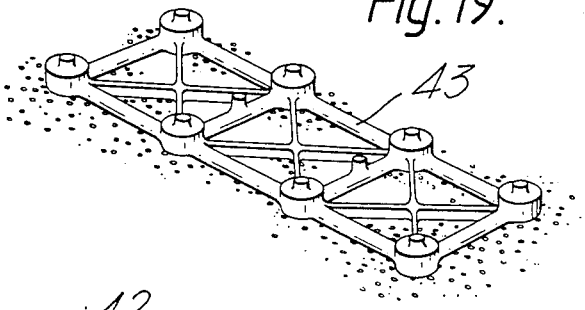
Figure 20:
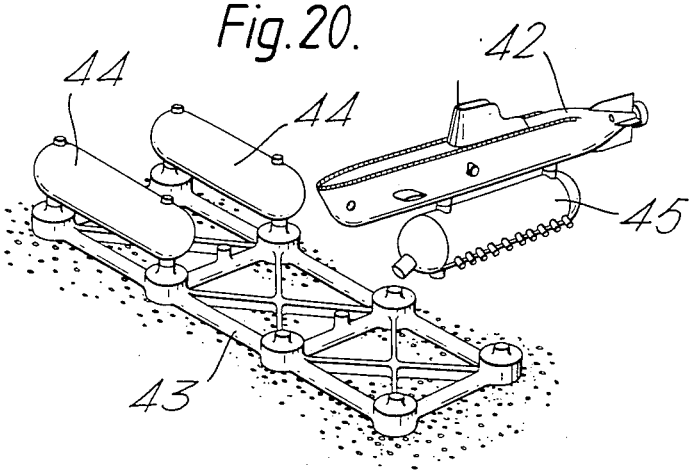
Figure 21:
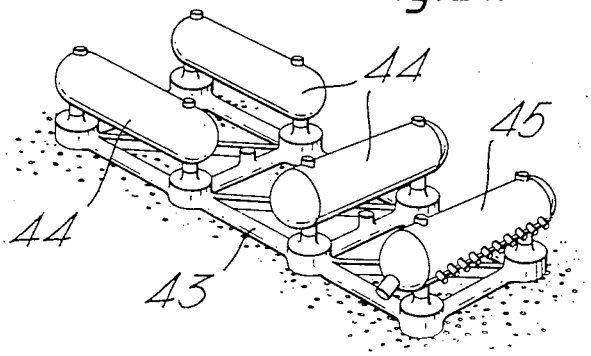
Figure 22A:
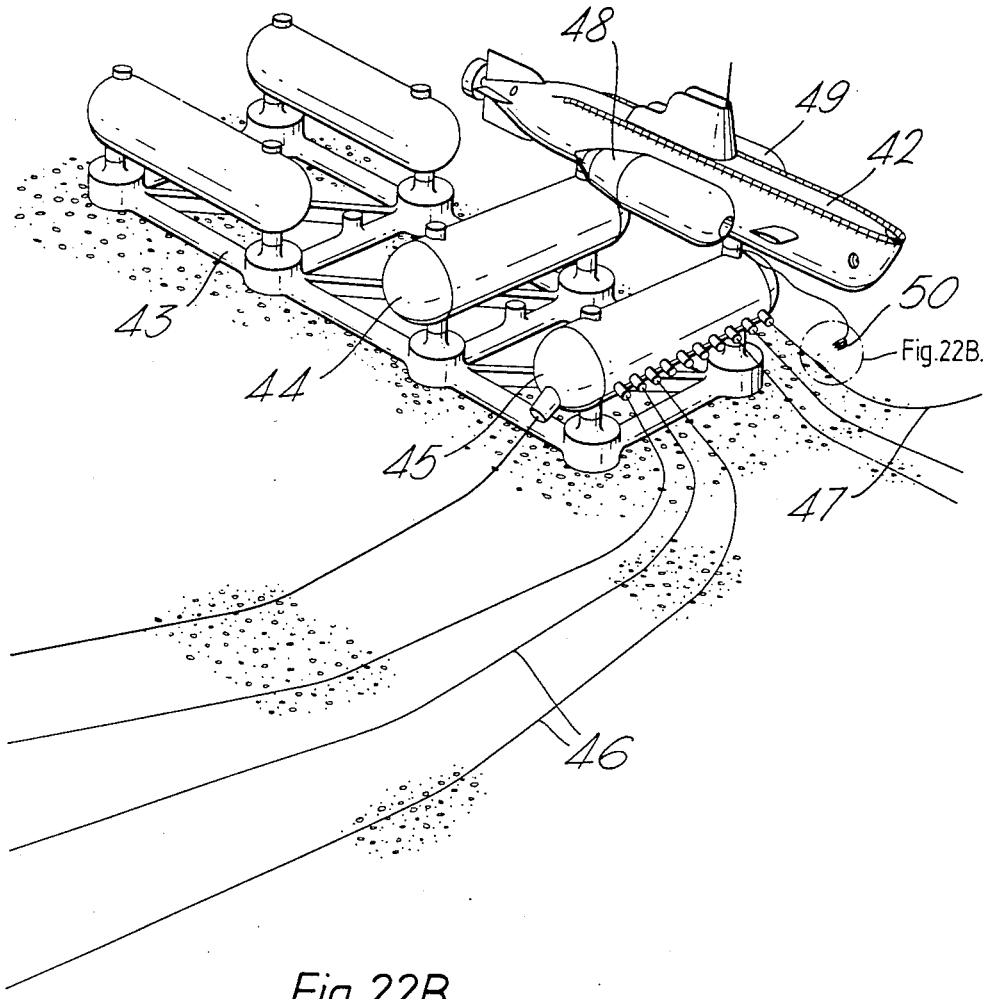
Figure 22B:
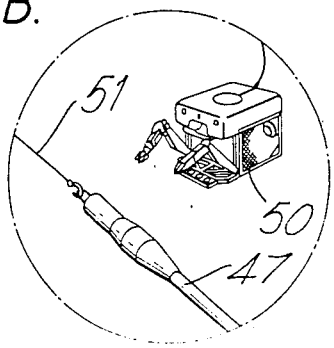
Figure 25:
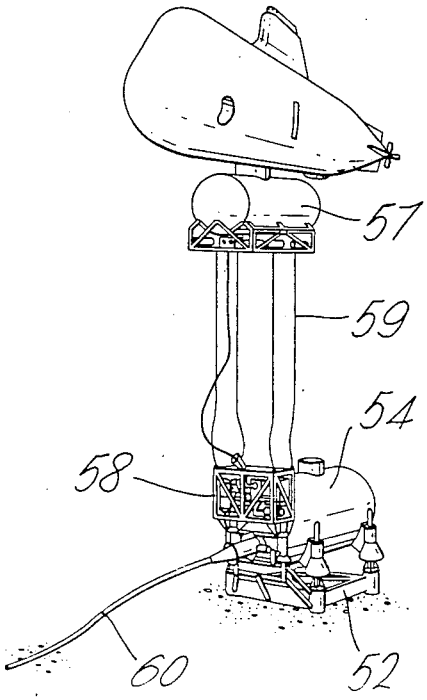
Figure 26:
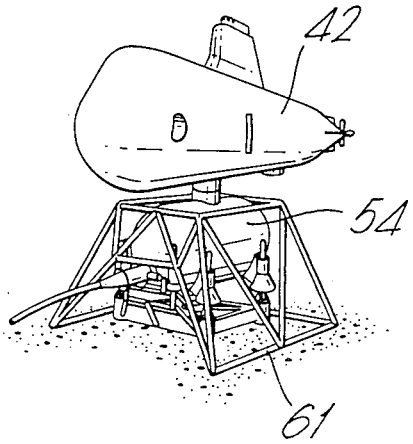
Figure 27:
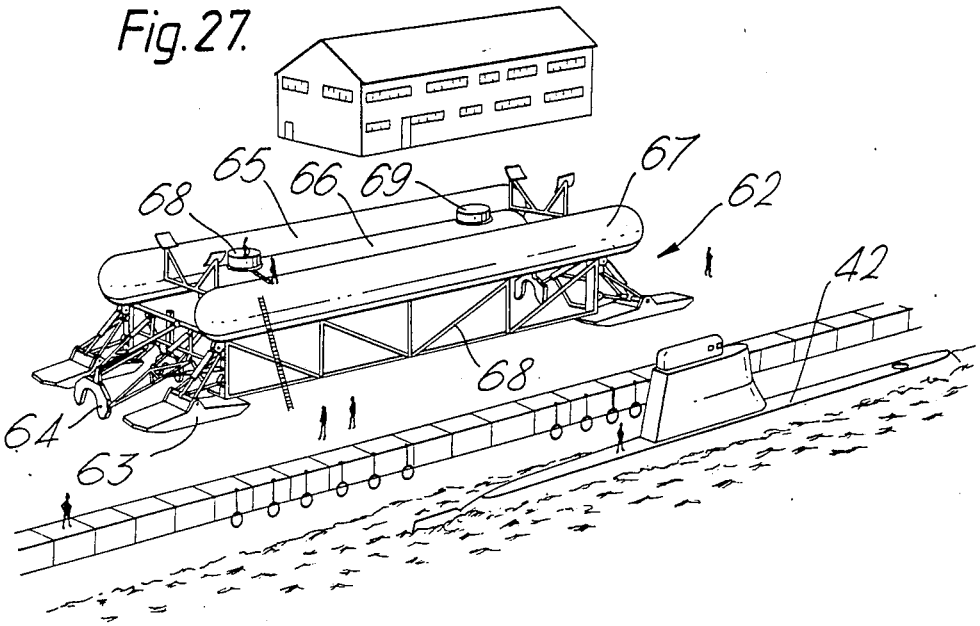
Figure 28:
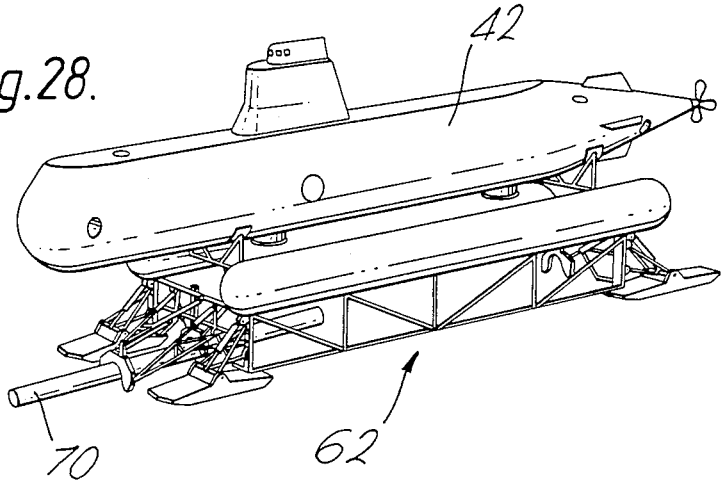
Figure 28:
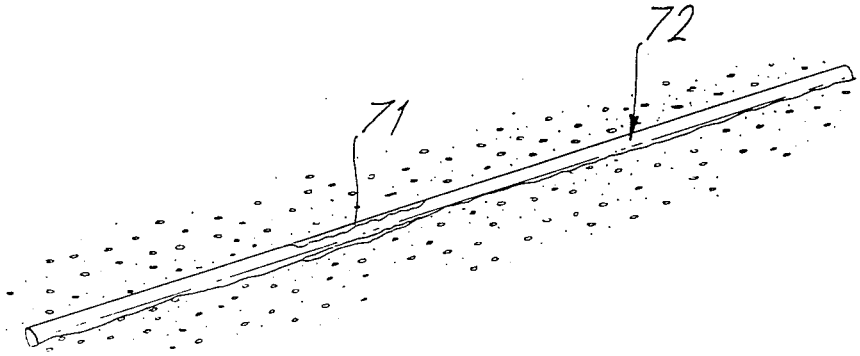

FIG. 5 shows a bottom frame designed for placement on the ocean floor and constructed of tubular framework, FIG. 6 shows the bottom frame of FIG. 5 connected with a submarine, FIG. 7 shows how one by means of a submarine can place connection means on the underwater platform, FIG. 8 shows the underwater platform with the connection means and units (modules) which later have been placed on it, FIG. 9 shows a horizontal projection of the underwater platform of FIG. 8, FIG. 10 shows a submarine with a smaller unit or module, FIG. 11 shows a submarine connected with two smaller units like the one depicted in FIG. 10, FIG. 12 shows a submarine and a unit in the form of a pressure chamber which contains a Christmas tree in a vertical embodiment, FIG. 13 shows a submarine and a pressure chamber with a Christmas tree in a horizontal embodiment, FIG. 14 shows a pressure chamber with a Christmas tree placed in its position on a wellhead and with an auxiliary unit connected to its side, FIG. 15 shows how a submarine can connect with an auxiliary unit by means of a side coupling, FIG. 16 shows how a unit containing a vertical Christmas tree can be connected sideways to a submarine, FIG. 17 shows how the unit of FIG. 16 can be pivoted into a horizontal position, for transport by means of the submarine, FIG. 18 shows a submarine with a connected bottom frame, FIG. 19 shows the bottom frame placed on the ocean floor, FIG. 20 shows the submarine with a connected module, FIG. 21 shows an underwater station after completion, FIGS. 22A and 22B show a pulling-in of a flowline, FIGS. 23–26 show the submarine used for constructing a wellhead, FIG. 27 shows a pipe reparation module on land, and FIG. 28 shows the pipe reparation module of FIG. 27 connected with a submarine.

Figure 1:
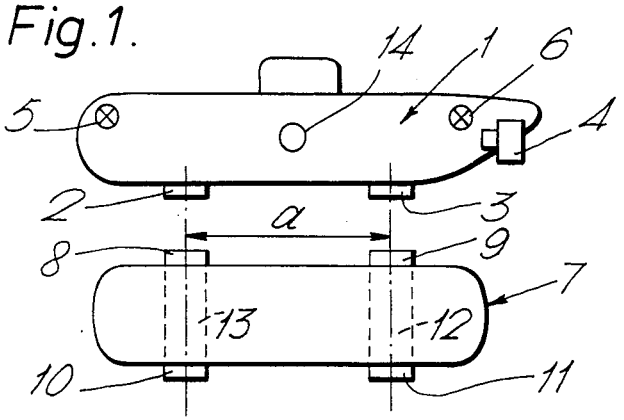
FIG. 1 shows a submarine with a typical unit or module.

In FIG. 1 a submarine 1 is shown. This submarine is shown with two standard couplings 2 and 3 on its bottom side. These standard couplings 2 and 3 form combined fastening and access devices which are standardized in the system with regard to the embodiment (measurements) and distance, here indicated by a. The submarine is autonomous, that is, it operates without a cable connection with a surface vessel and it has a crew. Apart from its usual machinery of propulsion, represented by the thruster 4, the submarine also has side thrusters 5,6 and a ballast system (not shown) for maneuvering/moving in all possible degrees of freedom.

Unit 7, as shown in FIG. 1, is in substance a pressure chamber, and contains necessary equipment, for example a manifold, a separation structure, etc. Unit 7 is provided with the standard couplings 8,9 and 10,11. These couplings constitute fastening and access devices having the system's standardized measurements and distance (a).

Unit 7 can, as previously mentioned, contain very disparate equipment, all according to the particular need, and based on the installed production systems and the risk of leakage of hydrocarbons (in the recovery of oil/gas) the unit might in its operating phase be filled with air, inert gas or water to which an inhibitor is added. The unit may also be sectioned into rooms and passages which can always be filled with air. This is indicated by broken lines in FIG. 1, where such rooms/-passages are designated by the numbers 12 and 13 respectively.

Figure 2:
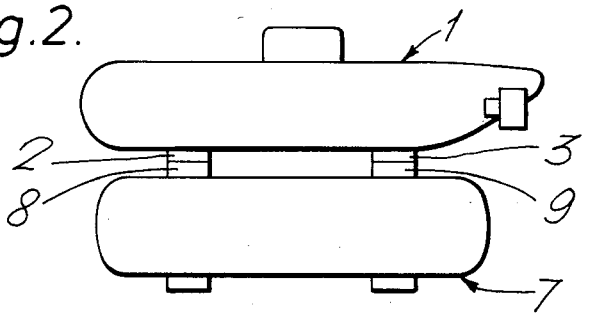
FIG. 2 shows the submarine and the unit connected.

FIG. 2 shows how the submarine 1 is connected with unit 7. This occurs in that the standard couplings 2,3 of the submarine 1 are connected to the standard couplings 8 and 9 respectively of unit 7. Unit 7 is now connected to the submarine 1 in order to be transported by it. Through the couplings 2,8 and 3,9 respectively one can from the submarine 1 obtain access to the inner pressure-resistant unit 7 if one so wishes. The submarine 1 is of course provided with sluices (not shown) in connection with the standard couplings 2 and 3 to make possible a safe transfer of personnel, and with necessary trapdoors and closing devices. The couplings may, if necessary, be telescopic.

Unit 7 may of course have any kind of suitable form and may possibly have a more streamlined design. During transport, care is taken that the unit has approximately neutral, that is no, buoyancy. The units may be provided with a ballast system to regulate buoyancy and the position of the center of gravity relating to the buoyancy. The system may with advantage be activated and operated from the submarine.

In addition to the two depicted standard couplings 2,3, the submarine may of course have one or more additional standard couplings, positioned on one of its sides or on both sides. Such a standard side coupling is shown in FIG. 1 and marked 14.

Figure 3:
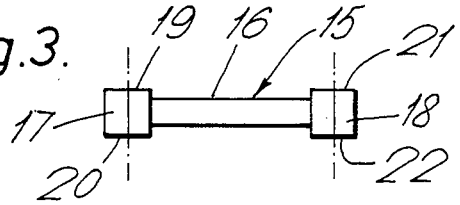
FIG. 3 shows a typical connection means.

FIG. 3 shows that a connection means 15 in a simple embodiment can consist of a tubular body 16 which in each end is connected with a housing 17,18, each such housing having an upper and a lower standard coupling, 19,20 and 21,22 respectively.

Figure 4:
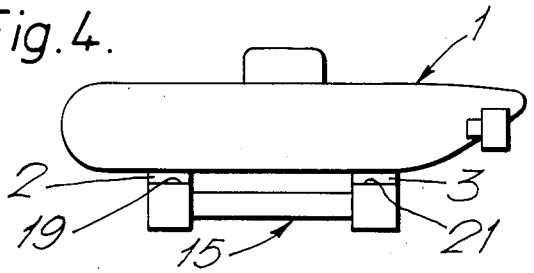
FIG. 4 shows the submarine and the connection means connected.

FIG. 4 shows how a submarine 1 by means of its standard couplings 2 and 3 is connected with such a connection means 15. Thus, in FIG. 4 the connection means 15 may be transported by means of the submarine 1, in the same way as explained above in connection with the transport of unit 7.

FIG. 5 shows the bottom frame 23, constructed of tubular framework. The bottom frame is provided with standard couplings (only four standard couplings are shown) 24,25, 26 and 27. FIG. 6 shows how the submarine 1 is connected with the bottom frame 23 for transport of the bottom frame by means of the submarine. The bottom frame is given a neutral buoyancy during transport, and by suitable ballasting one may also compensate for possibly uneven loads.

By means of the submarine 1 the bottom frame 23 may thus be placed on the ocean floor 28 (FIG. 7). FIG. 7 shows how one by means of the submarine 1 may place a connnection means 15 in its position on the bottom frame.

In the same way as explained above in connection with unit 7, the connection means 15 may be designed with rooms or passages which at all times may be filled with air or which possibly may be emptied for water or inert gas and filled with air as required, so that personnel may go down into these rooms, represented by said housings 17,18 of the connection means, and undertake the necessary coupling work etc.

FIGS. 8 and 9 show how the bottom frame 23 is constructed by using connection means and units. In FIGS. 8 and 9, the units and connection means are marked respectively 7 and 15, but the units and respectively the connection means do not need to be mutually alike. What is essential is that they have the necessary standard couplings.

On the bottom frame 23 in FIGS. 8 and 9, there are mounted four connection means 15 and four units or modules 7. The mounting sequence (replacement sequence) is arbitrary for the modules, and also for the connection means before the modules are mounted.

The structure shown in FIGS. 8 and 9 can receive and dock a submarine in eight different ways, all according to the particular need, for access, inspection and possibly mainteance.

The four modules may contain very disparate equipment and based on the installed components and the danger of leakage of hydrocarbons (in the recovery of oil/gas), the modules will be filled with air or inert gas (or water to which an inhibitor is added) in the operating phase. As mentioned above, the units or modules may also be sectioned into rooms and passages which will always be filled with air.

Before work begins, rooms filled with inert gas may be filled with air. It might then be necessary to shut down production or parts of it. With the broken-down (modular) arrangement shown, it will be simple to figure out a production flow chart which allows for partial shutting down when more extensive works are to be done and when it is impossible or undesirable to shut down the whole system. It will of course also be possible to replace the whole module.

As is evident from FIG. 9, there are altogether eight standard couplings facing upward. Some of these might be used for access via the submarine. In other cases the couplings may be used for more or less permanent additions of service or auxiliary modules, such as workshop modules, launcher and store room for pigs, energy packages, habitat module, pulling-in devices for flowlines and umbilicals, storage of chemicals, storage of mud for well-killing, etc.

In the novel underwater system there may also be included one or more energy modules as energy reserves for the submarine. Such a module may possibly be brought by the submarine on its trip from the shore. At the place of arrival one or more such energy modules may possibly be placed in advance, so that the submarine in this way may prolong its period of operation quite significantly, for example for the purpose of transporting units with a great towing resistance and a corresponding reduction in speed.

Smaller units or modules may have only one standard coupling on the top or bottom. One such smaller unit is shown in FIG. 10 and marked 30. It has an upper standard coupling 31 and a lower standard coupling 32.

FIG. 11 shows how the submarine 1 may be connected with two such smaller units 30 for the purpose of transporting them.

Different types of units, particularly service and tool units, energy units and storage units may be stored on the field; that is, it will not always be necessary to transport such units to the base between each time they are used.

A very important area where it will be of interest to use the novel underwater system is in connection with the supplementation of so-called satellite wells. The Christmas tree may here be mounted in a chamber which either is placed vertically or horizontally on the wellhead.

With the underwater system it will not be difficult to transport Christmas trees up to 50–100 tons. FIG. 12 shows a submarine 1 with a vertical chamber 33 containing a Christmas tree. The pressure chamber 33 has an upper standard coupling 34 and a lower standard coupling 35. FIG. 13 shows the submarine 1 in conjunction with a horizontal pressure chamber 36 having an upper standard coupling 37 and a lower standard coupling 38. By connecting the couplings 2 and 34 (FIG. 12) or by connecting the couplings 2 and 37 (FIG. 13), one may transport the Christmas tree by means of the submarine. The pressure chamber/Christmas tree 33 may possibly be provided with a side coupling 39, which makes transport possible with the pressure chamber 33 placed in a horizontal position.

FIGS. 16 and 17 show how a pressure chamber 33 can be connected by a standard coupling 14 on the side of the submarine 1 and then be pivoted into a horizontal position (FIG. 17). This gives less resistance for achieving a faster transport.

By comparison of FIGS. 16 and 17 it will be apparent that the coupling enables rotation of the Christmas tree chamber 33 between the vertical and horizontal positions shown.

FIG. 14 shows how the pressure chamber 33 with the pertaining Christmas tree is positioned on a wellhead 40. Reparation and maintenance can be performed through the upper access opening (standard coupling) 34, directly from the submarine or from a service module connected between the submarine and the pressure chamber. FIG. 14 shows how a pulling-in module 41 may be connected to the side of the pressure chamber. The pulling-in module 41 is designed for pulling in one or more pipelines. FIG. 15 shows how a submarine 1 by means of a standard coupling 14 on its side can be connected with the pulling-in module 41, which thus can serve as an auxiliary module (service module). By means of the submarine 1 one may of course also remove module 41, by disconnecting it from the pressure chamber 33.

One or more extra side couplings can give access for inspection or handling of the installation even during the operating phase. This applies to all units and not only to the pressure chamber containing the Christmas tree. Particular tool units or tool modules may then be connected in between, for example to be used for replacement of "wear—down components" such as throttlers etc. without personnel needing to enter the individual units.

The submarine can, of course, without any further preparation be used for personnel transport between different installations on the ocean floor, and for inspection assignments. For such purposes special service modules may be connected to the submarine. The laying of control cables from a special layingout module is another possible task.

From the above description, it will be apparent that the invention provides a system of installation, inspection, intervention and maintenance which constitutes a complete underwater system of great flexibility, so that one may take care of all presently conceivable tasks in connection with production systems installed on the ocean floor.

Transport of large and heavy units (even foundation frames or bottom frames) can be accomplished in that these are designed so that their buoyancy can be made approximately like zero, and in that the submarine connects with, moves and positions these. The breaking-down/modularizing of such large and heavy units may also be used if it is found advantageous. Units and components, including spare parts, can thus be transported from bases on land or dropped from ships or helicopters, to be caught by the submarine.

One will appreciate that the novel underwater system comprises interconnecting components and one or more submarines for servicing the plant, the components and the submarine having coupling points which in the system will be distributed in a horizontal modular grid which can lie on one or more planes. The individual components can be provided with dry or drainable rooms in connection with the coupling points.

Standard couplings on the side make possible that two (or more) submarines can be connected floating freely in a submerged state for the purpose of exchange of personnel (rescue operations), spare parts, tools, etc. for installations on the ocean floor. This also makes it possible to act as a "catamaran," transporting a submarine without a crew, etc.

The versatility of the novel underwater system is further elucidated by the examples given in FIGS. 18–28.

Thus FIGS. 18–22 show the construction of an underwater station with the novel system.

In FIG. 18 a submarine 42 is shown in a transport situation, with a connected bottom frame 43. In FIG. 19 the bottom frame 43 is shown placed on the ocean floor. The submarine is disconnected and has left to fetch a new unit 44,45 which it places on the bottom frame 43, as shown in FIG. 20. There are two units or modules 44 placed on the bottom frame, while the submarine maneuvers into position for placing a module 45. In FIG. 21, the underwater station is shown with the necessary modules 44, 45 in place.

FIGS. 22A and 22B show how the submarine 42 is used for pulling in and connecting flowlines 46, 47. The submarine 42 carries in FIGS. 22A and 22B a tool module 48 connected to its starboard side. On its port side one glimpses a connected energy module 49. The submarine 42 is connected with modules 44 and 45. From the tool module 48 an ROV (Remote Operated Vehicle) 50 is sent out. This remote controlled sub-unit 50 is used for guiding the flowline 47, which is pulled into the module 45 by means of a wire 51. The operation is monitored by personnel in the submarine, in the tool module and/or in the module 45. One will appreciate that in the work situation depicted in FIG. 22, personnel can stay in modules 44, 45 and perform desired or necessary work there. Personnel has access to the modules from the submarine through the previously mentioned combined coupling and access devices and through passages in the bottom frame.

Figure 23:
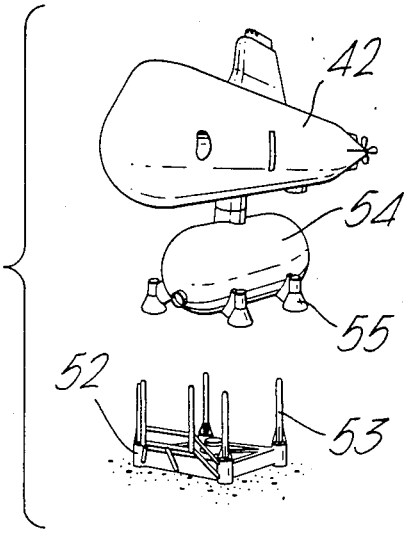
Figure 24:
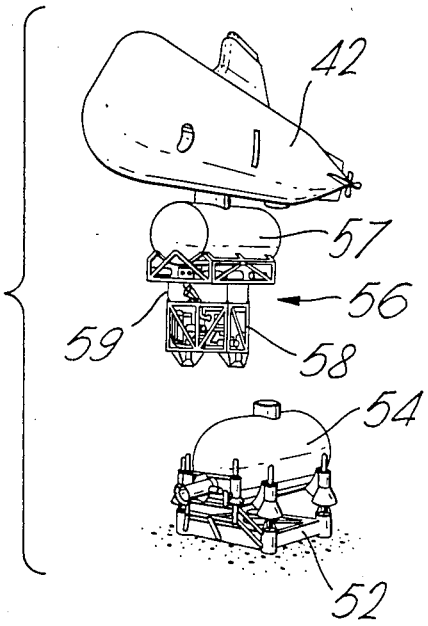

FIGS. 23–26 show how the submarine 42 can be used as a tool in constructing a wellhead. A frame 52 is placed on the ocean floor. This frame has guide posts 53 and is, for example, placed on the well site by means of the submarine. FIG. 23 shows the submarine 42 in a position above the frame 52 and carrying a chamber module 54 containing a Christmas tree. The chamber module is put down on the frame 52, the guide funnels 55 being pulled over the guide posts 53, as shown in FIG. 24, which shows the next step in the work operation, the submarine now having fetched a pulling-in module 56 and maneuvered into a position above the chamber module 54. The pulling-in module 56 consists here of two main parts, namely a tool part or chamber 57 and the pulling-in part itself 58, which is lowered down onto the frame/chamber module 52, 54 by means of wires 59. In a manner not further shown—a technique known per se is used—a flowline 60 is then pulled in and connected, as shown in FIG. 25. The pulling-in part 58 is disconnected and lifted up, and the submarine brings the equipment to a place for storage either on the ocean floor or at a base on land.

FIG. 26 shows the submarine 42 connected with the chamber module 54. Personnel can enter the chamber module and undertake necessary work there. The wellhead is in FIG. 26 shown protected by a frame cage 61, placed there by means of the submarine.

Finally, FIGS. 27 and 28 show how one within the framework of the novel underwater system can undertake the repair of a pipe. FIG. 27 shows a module 62 provided with support paws 63, claws 64, etc., the module comprising three cylindrical chamber bodies 65, 66 and 67. These are assembled in a frame-work 73 and the middle chamber body 66 has coupling and access openings 68 and 69, standardized according to the system. In FIG. 28, the module 62 is shown at sea, hanging under the submarine 42. In the module 62 there hangs a length of pipe 70 which shall replace the defect pipe section 71 of the pipeline 72 lying on the ocean floor. By means of the submarine 42, the module 62 is placed on the site of damage, after which replacement of the pipe section 71 can be undertaken. The process of repair does not constitute a part of the present invention and is therefore not further explained. The submarine can of course be used for other tasks while the repair of the pipe 72 takes place.

The above examples are not exhaustive, but are simply given to illustrate the potentials of the novel system.

Having described our invention, we claim:

1. A one-atmosphere underwater system for the recovery of natural resources, said system comprising:

(a) a plurality of pressure-resistant units containing production equipment and auxiliary facilities;

(b) connection members constructed and arranged to provide connection between selected ones of said pressure-resistant units;

(c) said pressure-resistant units and said connection members being constructed and arranged to fit into a modular system; each pressure-resistant unit including at least one standard access coupling and fastening means and each connection member including at least two standard access couplings and fastening means thereon; said access couplings being positioned so that a distance between adjacent couplings in said modular systems is a constant, selected, standardized distance (a), and said fastening means providing for engagement between selected ones of said pressure-resistant units and selected connection members;

(d) at least one submarine provided with at least a pair of access couplings thereon separated by said constant, selected, standardized distance (a) and fastening means for selective engagement with fastening means on said pressure-resistant units and said connection means.

2. A system according to claim 1 wherein each of said standard access couplings includes said fastening means thereon.

3. The systems according to claim 1 wherein said pressure-resistant units and said connection members each include spaces which may selectively be retained full of air, in an underwater environment.

4. The system according to claim 1 wherein each connection member includes a personnel passage extending between a pair of standard access couplings thereon.

5. A pressure-resistant unit for use in a system according to claim 1 including at least two standard access couplings thereon separated by said standardized distance (a).

6. A submarine for use in association with a system according to claim 1 including at least two standard access couplings thereon separated by said standardized distance (a).

7. A modular system for use in underwater operations, said modular system including:

(a) at least one submarine having means for autonomous motion; said submarine having at least two standardized access couplings and fasteners thereon separated, along a line and in a selected plane, by a selected distance (a);

(b) a plurality of pressure-resistant units each having at least a pair of standardized access couplings and fasteners thereon separated, along a line and in a selected plane, by said selected distance (a);

(c) at least one connection member including two sets of pairs of access couplings and fasteners thereon, each pair of access couplings including two standardized access couplings and fasteners separated, along a line and in a selected plane, by said selected distance (a); a first set of said two sets of pairs of access couplings and a second set of said two sets of pairs of access couplings being oppositely directed from one another;

(d) a bottom frame including a plurality of standardized access couplings and fasteners, adjacent pairs of said standardized access couplings and fasteners being spaced apart by said selected distance (a);

(e) whereby said submarine may be fastened to at least any selected one of: said bottom frame; said pressure-resistant units; and, said connection member to transport same and assemble same into said modular system.

8. The systems according to claim 7 including:

(a) a christmas tree-containing module.

9. The system according to claim 8 wherein:

(a) said christmas tree-containing module has an elongate shape with first and second ends and a sidewall portion; at least one of said christmas tree-containing module ends having a standardized access coupling and fastener thereon for attachment to a selected one of said pressure-resistant units and said connection members; said christmas tree-containing module having at least one standardized access coupling and fastener in said sidewall portion;

(b) said submarine has a sidewall with at least one standardized access coupling and fastener thereon whereby said submarine may selectively be coupled to said access coupling on said christmas tree-containing module sidewall; and (c) rotation means constructed and arranged to selectively rotate an orientation of said christmas tree-containing module relative to said submarine when coupled thereto;

(d) whereby said christmas tree-containing module may be selectively oriented between a preferred orientation for transport and a preferred orientation for attachment to a selected portion of said modular system.

* * * * *